US006522303B1

(12) United States Patent
West et al.

(10) Patent No.: US 6,522,303 B1
(45) Date of Patent: Feb. 18, 2003

(54) WIRELESS LAN WITH SELF-ORIENTING BATTLEFIELD ANTENNA AND INTEGRAL ELECTRONICS

(75) Inventors: James B. West, Cedar Rapids, IA (US); Amy E. Charron, Houghton, MI (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 43 days.

(21) Appl. No.: 09/845,937

(22) Filed: Apr. 30, 2001

(51) Int. Cl.[7] ..... H01Q 1/24; H01Q 13/10

(52) U.S. Cl. ..... 343/770; 343/702; 343/767; 455/90

(58) Field of Search ..... 343/767, 770, 343/700 MS, 702; 455/89, 90

(56) References Cited

U.S. PATENT DOCUMENTS

| | | | | | |
|---|---|---|---|---|---|
| 4,051,480 | A | | 9/1977 | Reggia et al. | 343/705 |
| 4,305,078 | A | | 12/1981 | Jones, Jr. et al. | 343/708 |
| 5,917,454 | A | * | 6/1999 | Hill et al. | 343/769 |
| 6,052,093 | A | * | 4/2000 | Yao et al. | 343/770 |
| 6,098,547 | A | | 8/2000 | West | 102/214 |
| 6,304,227 | B1 | * | 10/2001 | Hill et al. | 343/769 |
| 6,373,442 | B1 | * | 4/2002 | Thomas et al. | 343/767 |

* cited by examiner

*Primary Examiner*—Tan Ho
(74) *Attorney, Agent, or Firm*—Nathan O. Jensen; Kyle Eppele

(57) ABSTRACT

A system for deploying a wireless LAN in a battlefield which includes a quasi-cylindrical antenna/housing which is adapted to be positionally unstable in orientations where the antenna would be non-operational.

14 Claims, 1 Drawing Sheet

WIRELESS LAN WITH SELF-ORIENTING BATTLEFIELD ANTENNA AND INTEGRAL ELECTRONICS

FIELD OF THE INVENTION

The present invention generally relates to battlefield eletronics, and more particularly relates to battlefield transmitters and receivers, and even more particularly relates to mechanically robust air-dropped, artillery-launched, and infantry-deployed battlefield wireless LANs.

BACKGROUND OF THE INVENTION

In recent years, wireless local area networks (LANs) have gained popularity in many industries. The battlefield is yet another potential arena in which wireless LANs could be deployed. The U.S. Government has proposed a program known as WINS, in which wireless LANs will be used in battlefield situations. However, the battlefield often necessitates extraordinary robustness and ruggedness requirements when compared to design requirement associated with consumer or industrial electronics. For example, many battlefield electronic devices are either air dropped or launched from a cannon. Components of wireless LANs would be no exception.

The antennae used for battlefield electronic devices also must meet extraordinary requirements. The proposed WINS wireless LAN will use numerous wireless transceivers scattered over the surface of the ground. The wireless transceivers will communicate with each other to form a LAN, and they will also communicate with sources and destinations of information such as mobile communication devices, either handheld by infantry, coupled to vehicles such as tanks, trucks, or remotely piloted vehicles. The wireless LAN may also receive information from manned and unmanned surveillance devices, etc. The general purpose of the WINs wireless LAN is to provide an army with a flexible, reliable, and robust system to allow secure terrestrial communication over a defined battlefield or other region.

One proposal has been to utilize a ¼ wave monopole antenna in association with the wireless LAN transceiver chassis. Such a monopole antenna would often be on the order of 8.4 inches tall plus the height of the transceiver chassis. It would require a ½ wavelength ground plane (approximately 17 inches for a 350 MHz transceiver). While a ¼ wavelength monopole antenna could be used, it does have several disadvantages. The 8-inch height in addition to the transceiver chassis could make the wireless LAN transceiver module easier to be visually detected and disabled by approaching infantry. The ½ wavelength ground plane is often too large to have a fixed plate and post placement mechanically deployed ground wires, while theoretically capable of serving as a ground plane, are often mechanically unreliable in practice. Also, such monopole antennae are readily susceptible to orientational problems, such as when an antenna lands on its side, and transmits up to the sky, where it can be more readily detected by air surveillance, instead of transmitting horizontally to the users on the ground. Additionally, polarization mismatch (i.e., cross polarization) can be a serious problem in such cases.

While a helical monopole antenna would have a shorter height characteristic, it would still suffer from many of the same shortcomings as does the ¼ wavelength monopole whip antenna. In addition, the helical monopole has a lower radiation efficiency and is more difficult to impedance match.

Conical and cylindrical slot antennae have been proposed in the past for various military uses. U.S. Pat. No. 6,098,547 entitled Artillery Fuse Circumferential Slot Antenna For Positioning and Telemetry by James B. West, issued on Aug. 8, 2000; U.S. Pat. No. 4,305,078 entitled Multifrequency Series-Fed Edge Slot Antenna by Jones et al. issued on Dec. 8, 1981; and U.S. Pat. No. 4,051,480 entitled Conformal Edge-Slot Radiators by Reggia et al. issued on Sep. 27, 1977, all describe slot antennae used in military applications.

While these slot antennae have been used extensively in the past, they do have some shortcomings if proposed for battlefield LAN use. First of all, none of these above-mentioned antennae designs addresses battlefield deployable wireless LANs and the antennae requirements associated with such an application. None of these references suggests how one might aerially deploy wireless LAN transceivers across the surface of a battlefield and maintain proper antennae orientation (co-polarized reception and transmission with the LAN) and transceiver integrity.

Consequently, there exists a need for methods and systems for deploying wireless LANs on a battlefield in an efficient manner.

SUMMARY OF THE INVENTION

It is an object of the present invention to provide a system and method for deploying a wireless LAN in a battlefield or non-battlefield application in an efficient manner.

It is a feature of the present invention to utilize a quasi-conical/quasi cylindrical antenna/housing.

It is another feature of the present invention to include an antenna/housing shape which has a non-stable orientation in non-operational orientations.

It is an advantage of the present invention to achieve improved efficiency in battlefield deployment and use of wireless LANs.

The present invention is an apparatus and method for providing a wireless LAN in a battlefield which is designed to satisfy the aforementioned needs, provide the previously stated objects, include the above-listed features, and achieve the already articulated advantages. The present invention is carried out in a "wasted transceiver-less" manner in a sense that the number of transceivers which are unusable in the battlefield because of improper orientation and other deployment and use related faults has been greatly reduced.

Accordingly, the present invention is a system and method including a wireless LAN in a quasi-conical/quasi-cylindrical antenna/housing which is not positionally stable in non-operational orientations.

BRIEF DESCRIPTION OF THE DRAWINGS

The invention may be more fully understood by reading the following description of the preferred embodiments of the invention, in conjunction with the appending drawings wherein.

DETAILED DESCRIPTION

Figure 1:
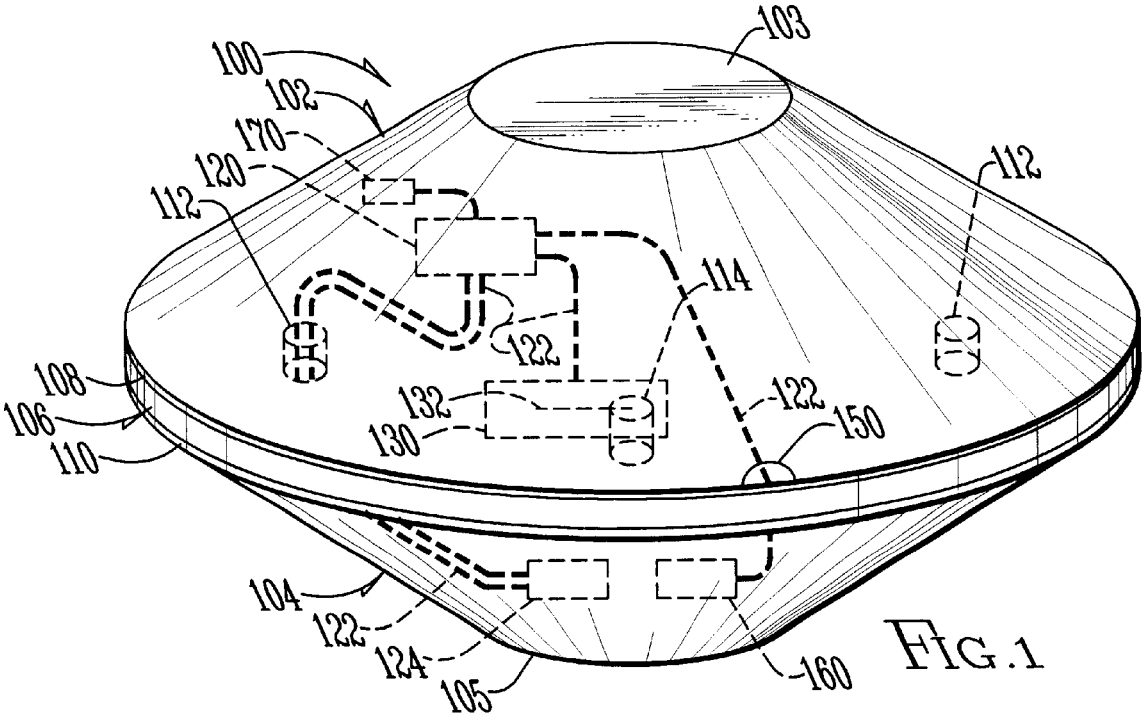
FIG. 1 is a perspective view of an antenna/housing of the present invention.

Now referring to the drawings wherein like numerals refer to like matter throughout, and more specifically referring to FIG. 1, there is shown a system of the present invention generally designated as a battlefield wireless LAN transceiver pod 100, including a top antenna/housing section 102 and a bottom antenna/housing section 104. These sections are preferably conductive enclosures which may be as simple as a truncated cone. In other words, the shape of top antenna/housing section 102 and bottom antenna/housing section 104 may be described as a cone which has had the tip portion (itself a cone) removed. Top flat circular base 103 and bottom flat circular base 105 are the surfaces which match the size of the base of the hypothetically removed cone. Top flat circular base 103 and bottom flat circular base 105 are designed to be the primary surface of the battlefield wireless LAN transceiver pod 100 which would contact the ground when the battlefield wireless LAN transceiver pod 100 comes to rest after impact with the ground.

Figure 2:
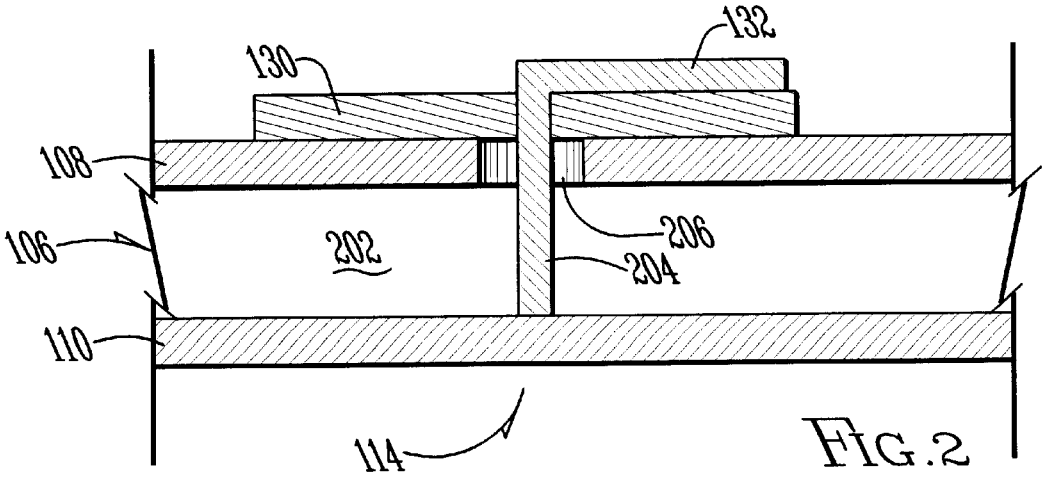
FIG. 2 is a cross-sectional view of the central antenna feed portion of FIG. 1.

Disposed between top antenna/housing section 102 and bottom antenna/housing section 104 is slot antenna 106, which in a preferred embodiment is approximately 0.25 inches in height. Slot antenna 106 has a slot antenna top plate 108 which is a metalization on the antenna dielectric 202 (FIG. 2). Similarly, slot antenna bottom plate 110 is a metalization on antenna dielectric 202. Preferably, top antenna/housing section 102 and bottom antenna/housing section 104 are conductive materials which are sufficiently robust to withstand the collisions with the ground that are to be expected when battlefield wireless LAN transceiver pod 100 is aerially deployed. The thickness of top antenna/housing section 102 and bottom antenna/housing section 104 may in a preferred embodiment be 4.7 inches base diameter with an approximate height of 1.0 in. and be made of aluminum or other RF conductive material. The material for slot antenna top plate 108 and slot antenna bottom plate 110 also is conductive, but typically need not be as thick as top antenna/housing section 102 and bottom antenna/housing section 104. Top antenna/housing section 102 and slot antenna top plate 108 preferably will be coupled together by a perimeter weld or other conductive and strong joint.

Disposed in slot antenna 106 are inductive post/plated through holes 112 which can serve to tune the resonant frequency of the slot antenna 106. Inductive post/plated through hole 112 also may be adapted and configured to receive therethrough inter-hemisphere connecting wire 122. Inter-hemisphere connecting wire 122 may be used to connect electronics located on opposite sides of slot antenna 106. For example, there is shown a wireless LAN transceiver/processor 120 under top antenna/housing section 102 and a battery 124 under the bottom antenna/housing section 104. Inter-hemisphere connecting wire 122 can be used to connect any type of system component on opposite side of slot antenna 106. Inductive post/plated through hole 112 may be insufficient to permit all of the required inter-hemisphere connecting wires 122 to connect with electronic device 160. In such cases, it may be desirable to forego additional inductive post/plated through holes 112 because of their effect on the resonant frequency of the slot antenna 106 and instead utilize a "mouse bite" perimeter hole 150.

Wireless LAN transceiver/processor 120 may contain and use software and/or circuitry to allow communication between other battlefield wireless LAN transceiver pods 100 (not shown but preferably identical), so that when multiple battlefield wireless LAN transceiver pods 100 are used, a network or wireless LAN can be realized. The numerous battlefield wireless LAN transceiver pods 100 may also contain software, circuitry, communication equipment, radios, etc. to communicate with mobile electronics equipment such as handheld processors which may be carried by infantry in the battlefield. The battlefield wireless LAN transceiver pods 100 and their resulting wireless LAN can also communicate with other mobile or temporary communication or surveillance devices. The battlefield wireless LAN transceiver pods 100 may be airdropped and blanket a region, thereby allowing communication on and off the wireless LAN with devices which are relatively low power.

Also shown in FIG. 1, antenna feed 114 is shown coupled to a microstrip circuit board 130 having a microstrip circuit trace 132 thereon which is coupled to wireless LAN transceiver/processor 120. Other feed configurations, such as a coaxial cable feed, are contemplated as well.

The battlefield wireless LAN transceiver pod 100 may also include a switch 170 which is coupled to wireless LAN transceiver/processor 120 where the switch is any type of switch which will automatically prohibit transmission by wireless LAN transceiver/processor 120 if the battlefield wireless LAN transceiver pod 100 happens to be vertically oriented.

The battlefield wireless LAN transceiver pod 100 of the present invention is preferably physically small in size. Also it is preferable that it is electrically small as well. In a preferred embodiment the antenna has a maximum diameter of $0.14\lambda$ and a height of $0.07\lambda$. This is especially desirable when the LAN is operating at low frequencies.

A more detailed understanding of the antenna feed 114 can be obtained by now referring to FIG. 2, which shows generally the slot antenna 106. Slot antenna 106 has an antenna dielectric 202 with slot antenna top plate 108 and slot antenna bottom plate 110 disposed on opposing sides. Antenna dielectric 202 is preferably a low loss dielectric such as BT with a dielectric constant of 4.5. Slot antenna top plate 108 is shown having a metalization free feed region 206 therein which has an antenna central feed probe 204 extending therethrough, which may have a preferred diameter of 0.050 inches. Antenna central feed probe 204 is electrically coupled to slot antenna bottom plate 110 and is electrically isolated from slot antenna top plate 108. Antenna central feed probe 204 is shown coupled to a microstrip circuit trace 132 on microstrip circuit board 130. Microstrip circuit board 130 is a dielectric material. Microstrip circuit board 130, as well as an interconnecting transmission line, may be employed for impedance matching purposes as well. Microstrip printed circuit board 130 can also be implemented as conventional strip line transmission line technology.

The resonant frequency of the battlefield wireless LAN transceiver pod 100 is determined by several factors, including the dielectric constant of antenna dielectric 202, the diameter of the antenna, the number, diameter and radial distance of inductive post/plated through holes 112. The theory of resonant frequency characteristics and of tuning slot antennae is well known in the art and is also described in an article entitled "Theory of the input behavior of a dielectric filled edge-slot antenna" by Dipak L. Sengupta; Luis F. Martins-Camelo; Howard S. Jones, Jr. and Danield H. Schaubert, which is found in Volume 1 of the IEEE 1979 Publication of Antennas and Propagation.

In operation, the apparatus and method of the present invention as described in FIG. 1, could function as follows:

1. Numerous battlefield wireless LAN transceiver pods 100 are permitted to drop to the surface of the earth.
2. These battlefield wireless LAN transceiver pods 100 are allowed to be pulled by gravity to a stable position where top flat circular base 103 or bottom flat circular base 105 are disposed against the ground.

3. A signal is applied to each of the antenna feeds 114 and a transmission is emitted from each slot antenna 106, in a pattern such that it is directed along the surface of the ground, and to neighboring battlefield wireless LAN transceiver pods 100.

The present invention is described herein as having a single slot antenna It should be understood that the present invention is intended to include a multi-frequency band assembly by stacking more than one of the slot antenna sections. For example, the stack up could be as follows:

1. Top truncated cone housing, similar to top antenna/housing section 102;
2. Slot antenna #1 similar to slot antenna 106;
3. Cylindrical housing, which could be a relatively short cylinder of equal diameter as slot antenna 106;
4. Slot antenna #2, similar to slot antenna 106;
5. Bottom truncated cone, similar to bottom antenna/housing section 104.

This concept can be extended beyond that of two antennas if required.

Throughout this description, reference is made to battlefield wireless LANs, because it is believed that the beneficial aspects of the present invention would be most readily apparent when used in connection with such systems; however, it should be understood that the present invention is not intended to be limited to wireless LANs and should be hereby construed to include other non-battlefield applications as well. Examples of potential other uses of the present invention may include but need not be limited to the following: environmental sensing, surveillance, personnel monitoring and cargo tracking.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

What is claimed is:

1. An apparatus comprising:

a first top antenna/housing section with a conductive shell;

a first bottom antenna/housing section with a conductive shell;

a first slot antenna disposed between said first top antenna/housing section and said first bottom antenna/housing section;

wherein said first top antenna/housing section is hollow and contains electronic communication equipment;

wherein said first bottom antenna/housing section is hollow and contains electronic equipment; and;

wherein said first top antenna/housing section and said first bottom antenna/housing section are coupled, shaped and configured so that said apparatus is positionally unstable if said slot antenna is oriented such that its axis of transmission polarization is substantially vertical.

2. An apparatus of claim 1 wherein said first top antenna/housing section has a truncated conical shape with a broader end region being adjacent to said slot antenna.

3. An apparatus of claim 1 wherein said apparatus is sized, adapted and configured to be shot from a cannon.

4. An apparatus of claim 1 wherein said first slot antenna has a first dielectric core between two first parallel conductive plates and an inductive post/plated through first hole extending through said first dielectric core and connecting said first parallel conductive plates.

5. An apparatus of claim 4 wherein an inter-hemisphere connecting first wire is disposed in said inductive post/plated through first hole.

6. An apparatus of claim 5 further comprising a first wireless LAN transceiver/processor disposed in said first top antenna/housing section.

7. An apparatus of claim 6 further comprising a first battery disposed in said first bottom antenna/housing section.

8. An apparatus of claim 7 wherein said inter-hemisphere connecting first wire connects said first wireless LAN transceiver/processor with said first battery.

9. An apparatus of claim 8 wherein said first top antenna/housing section has a truncated conical shape with a first top broader end region being adjacent to a first side of said first slot antenna.

10. An apparatus of claim 9 wherein said first bottom antenna/housing section has a truncated conical shape with a first bottom broader end region being adjacent to a second side of said first slot antenna.

11. An apparatus of claim 10 wherein said first wireless LAN transceiver/processor is adapted and configured with first software to function as a wireless LAN.

12. An apparatus of claim 11 wherein said first slot antenna top plate has a first perimeter hole along a peripheral edge with inter-hemisphere connecting wires extending therethrough.

13. An apparatus of claim 12 further comprising a first switch to prohibit transmission when a primary transmission axis is substantially vertical.

14. An apparatus of claim 13 further comprising:

a second top antenna/housing section;

a second bottom antenna/housing section;

a second slot antenna disposed between said second top antenna/housing section and said second bottom antenna/housing section; and, a second wireless LAN transceiver/processor disposed in said second top antenna/housing section.

* * * * *